US010968088B2

(12) United States Patent
Dorsey et al.

(10) Patent No.: US 10,968,088 B2
(45) Date of Patent: Apr. 6, 2021

(54) REMOTE-CONTROLLED SHINGLE INSTALLATION JACK

(71) Applicants: Andrew Mathias Dorsey, Lothian, MD (US); Joseph Anthony Wills, Jr., Lothian, MD (US)

(72) Inventors: Andrew Mathias Dorsey, Lothian, MD (US); Joseph Anthony Wills, Jr., Lothian, MD (US)

( * ) Notice: Subject to any disclaimer, the term of this patent is extended or adjusted under 35 U.S.C. 154(b) by 0 days.

(21) Appl. No.: 15/808,624

(22) Filed: Nov. 9, 2017

(65) Prior Publication Data

US 2019/0135602 A1 May 9, 2019

(51) Int. Cl.

| | |
|---|---|
| ***E04G 3/28*** | (2006.01) |
| ***E04G 3/34*** | (2006.01) |
| ***E04G 5/04*** | (2006.01) |
| ***B66F 11/04*** | (2006.01) |

(52) U.S. Cl.

CPC ..... *B66F 11/04* (2013.01); *E04G 3/34* (2013.01); *E04G 5/041* (2013.01); *E04G 2003/286* (2013.01)

(58) Field of Classification Search

CPC . B66F 11/04; E04G 3/34; E04G 5/041; E04G 2003/236; E04D 15/04; E04D 15/02

See application file for complete search history.

(56) References Cited

U.S. PATENT DOCUMENTS

| | | | | |
|---|---|---|---|---|
| 2,814,533 | A * | 11/1957 | Van Horn | E04G 3/26 182/129 |
| 3,173,166 | A * | 3/1965 | Christensen | E04D 15/04 118/108 |
| 3,298,584 | A * | 1/1967 | Miller | E04D 15/04 227/111 |
| 3,666,054 | A * | 5/1972 | Ellings | B66B 9/16 182/103 |
| 3,769,916 | A * | 11/1973 | Hogan | E04D 15/02 104/173.1 |
| 3,842,934 | A * | 10/1974 | Bartlett | E04D 15/02 182/37 |
| 4,785,606 | A * | 11/1988 | Burton | E04D 15/025 52/749.12 |
| 5,205,103 | A * | 4/1993 | Burton | E04D 15/02 182/45 |
| 7,424,932 | B1 * | 9/2008 | Murphy | E06C 1/345 182/103 |
| 9,945,128 | B1 * | 4/2018 | Baird | E04D 15/02 |
| 2019/0032338 | A1 * | 1/2019 | Baird | E04D 15/07 |

* cited by examiner

*Primary Examiner* — Anita M King

(57) ABSTRACT

The shingle installation jack devices may be mounted once at a first roof level, providing support for the walk board. When installation or repair of the shingles is complete at the first level of the roof, the shingle installation jack devices may be operated in tandem to raise the level of the walk board to a second level of the roof. Shingle installation and/or repair may then be carried out at this second roof level without the need to re-mount the walk board supports at the second level. The shingle installation jack devices may also be run in reverse to lower the walk boards. The shingle installation device includes a frame and utilizes a winch motor to adjust the effective length of a cable and thus adjustably raise or lower the walk boards to any desired roof level.

11 Claims, 3 Drawing Sheets

REMOTE-CONTROLLED SHINGLE INSTALLATION JACK

BRIEF DESCRIPTION OF THE INVENTION

The present invention is generally related to the field of roof installation and repair, and more particularly related to a shingle installation jack device for raising and lowering a walk board via remote control to facilitate efficient shingle installation or repair on a roof of a building or structure. The herein disclosed remote-controlled shingle installation jack device may be utilized as a pair of devices; a first remote-controlled shingle installation jack device is mounted on a first end of a walk board and a second remote-controlled shingle installation jack device is mounted on a second end of a walk board. The shingle installation jack devices may be mounted once at a first roof level, providing support for the walk board. When installation or repair of the shingles is complete at the first level of the roof, the shingle installation jack devices may be operated in tandem to raise the level of the walk board to a second level of the roof. Shingle installation and/or repair may then be carried out at this second roof level without the need to re-mount the walk board supports at the second level. The shingle installation jack devices may also be run in reverse to lower the walk boards.

The herein disclosed shingle installation jack device is capable of continuous movement up and down the roof, allowing for placement of the walk boards at any roof level (or roof height) as desired by a user. In other words, the walk boards may be mechanically raised or lowered to any roof level by the herein disclosed shingle installation jack device, facilitating use with installation of any size or type of roof shingle. The herein disclosed shingle installation jack device may additionally be used for all roof repair or inspection purposes, even if they do not involve shingles. For example, the herein disclosed shingle installation jack devices may be advantageously utilized during chimney repair on buildings or structures having a slanted roof.

An exemplary embodiment of the herein disclosed shingle installation device comprises: a frame having a bottom member for anchoring a pulley, a first slider member, a second slider member, and a top member for supporting a walk board and for anchoring a first end of a spring, wherein the top member is in parallel with the bottom member and the first slider member is in parallel with the second slider member; a mounting assembly for anchoring a winch motor, wherein the mounting assembly has an upper surface for anchoring a second end of the spring and a lower surface for anchoring an eye bolt; a cable having an adjustable effective length running from the winch motor, through the pulley, and back to the eye bolt, wherein the adjustable effective length of the cable is controllable by the winch motor; and the spring spanning from the top member of the frame to the upper surface of the mounting assembly.

CROSS-REFERENCES TO RELATED APPLICATIONS

Not applicable.

STATEMENTS AS TO THE RIGHTS TO INVENTIONS MADE UNDER FEDERALLY SPONSORED RESEARCH OR DEVELOPMENT

Not applicable.

REFERENCE TO A "SEQUENCE LISTING," A TABLE, OR A COMPUTER PROGRAM LISTING APPENDIX SUBMITTED ON A COMPACT DISK

Not applicable.

BACKGROUND OF THE INVENTION

Most single-family houses have slanted roofs lined with shingles (or tiles) for protecting the roof from environmental elements such as rain and snow. Other types of building or structures may also utilize such a slanted roof design, lined with shingles for protection from the elements. Shingles are generally installed manually by workers or contractors physically located on the slanted roof while they work. Because the roofs are slanted, walk boards are temporality positioned on the roof to provide a supporting surface for the workers or contractors to walk on, or sit or kneel on, during their work.

Standard procedure for roof work currently involves mounting the walk board(s) at a particular roof level (or roof height) so that the workers and contractors may carry out their installation or repair work at this roof level. When work at this level is complete, the walk boards must be re-mounted at a second level before installation or repair work can commence at this second level. This procedure may have to be repeated many times in order to complete shingle installation or repair over an entire roof. The process of re-mounting the walk boards securely at various roof levels is important for safety of the workers and contractors, but the process is tedious and time consuming. And if the re-mounting is done incorrectly, the walk boards may be unsecure and thus dangerous for the workers and contractors. This standard procedure is not very efficient.

There is a demonstrated need, therefore, for a device that may eliminate the need to continuously re-mount walk boards during installation or repair of roof shingles. The present invention provides such a device than may be utilized to facilitate installation or repair of roof shingles at various roof levels without the need to re-mount the walk boards.

DETAILED DESCRIPTION OF THE INVENTION

The present invention is generally related to the field of roof installation and repair, and more particularly related to a shingle installation jack device for raising and lowering a walk board via remote control to facilitate efficient shingle installation or repair on a roof of a building or structure. The herein disclosed remote-controlled shingle installation jack device is, in a preferred embodiment, intended to be utilized as a pair of devices with a first remote-controlled shingle installation jack device mounted on a first end of a walk board and a second remote-controlled shingle installation jack device mounted on a second end of a walk board.

An exemplary embodiment of the herein disclosed shingle installation device comprises: a frame having a bottom member for anchoring a pulley, a first slider member, a second slider member, and a top member for supporting a walk board and for anchoring a first end of a spring, wherein the top member is in parallel with the bottom member and the first slider member is in parallel with the second slider member; a mounting assembly for anchoring a winch motor, wherein the mounting assembly has an upper surface for anchoring a second end of the spring and a lower surface for anchoring an eye bolt; a cable having an adjustable effective length running from the winch motor, through the pulley, and back to the eye bolt, wherein the adjustable effective length of the cable is controllable by the winch motor; and the spring spanning from the top member of the frame to the upper surface of the mounting assembly.

Throughout this specification the term "shingle" will mostly be used to refer to the object(s) that are to be installed or repaired on a slanted roof of a building or structure. As used herein, the term shingle is intended to include any type of roofing material, such as tiles or beams for example, that may be installed or repaired on a roof.

Figure 1:
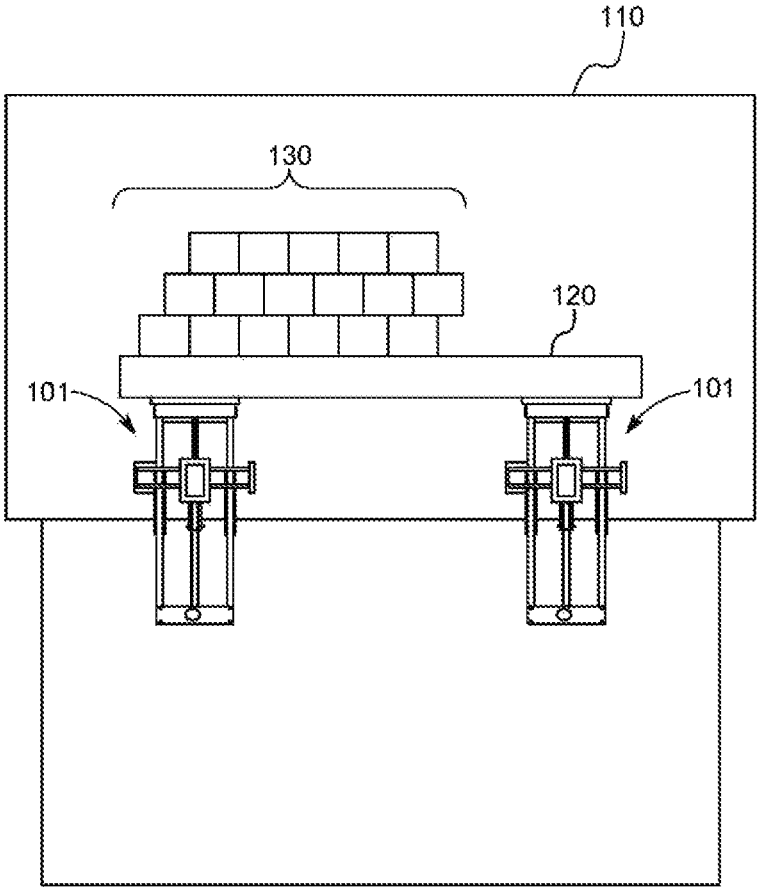
FIG. 1 illustrates an overview of a pair of the herein disclosed shingle installation jack devices during use to raise or lower a walk board during installation of shingles on a slanted roof, in accordance with the present invention.

Referring to FIG. 1, an overview of a pair of the herein disclosed shingle installation jack devices during use to raise or lower a walk board during installation of shingles on a slanted roof is shown. Walk board 120 is positioned and secured on roof 110 by two shingle installation jack devices 101 so that shingles 130 may be installed or repaired. As an example of utilizing the present invention, a first shingle installation jack device 101 is positioned at a first end of walk board 120 and a second shingle installation jack device 101 is positioned at a second end of walk board 120. Each shingle installation jack device 101 includes a mounting assembly (identified in FIG. 2A and FIG. 2B; see mounting assembly 8) and a top member (also identified in FIG. 2A and FIG. 2B; see top member 12). Walk board 120 is supported on each end by a top member of each shingle installation jack device 101. Each of the shingle installation jack devices 101 are each removably but securely attached to (or anchored to) roof 110 by the mounting assembly of each shingle installation jack device 101. When users (workers or contractors, for example) wish to raise the level of walk board 120 so as to access a higher level (or higher height) of roof 110, the users may operate the herein disclosed shingle installation jack devices 101 in tandem to mechanically raise the top member of each shingle installation jack device 101 to a desired level, and thus raise the level of walk board 120 to the desired level. It also may be possible to independently operate each individual shingle installation jack device 101.

Figure 2A:
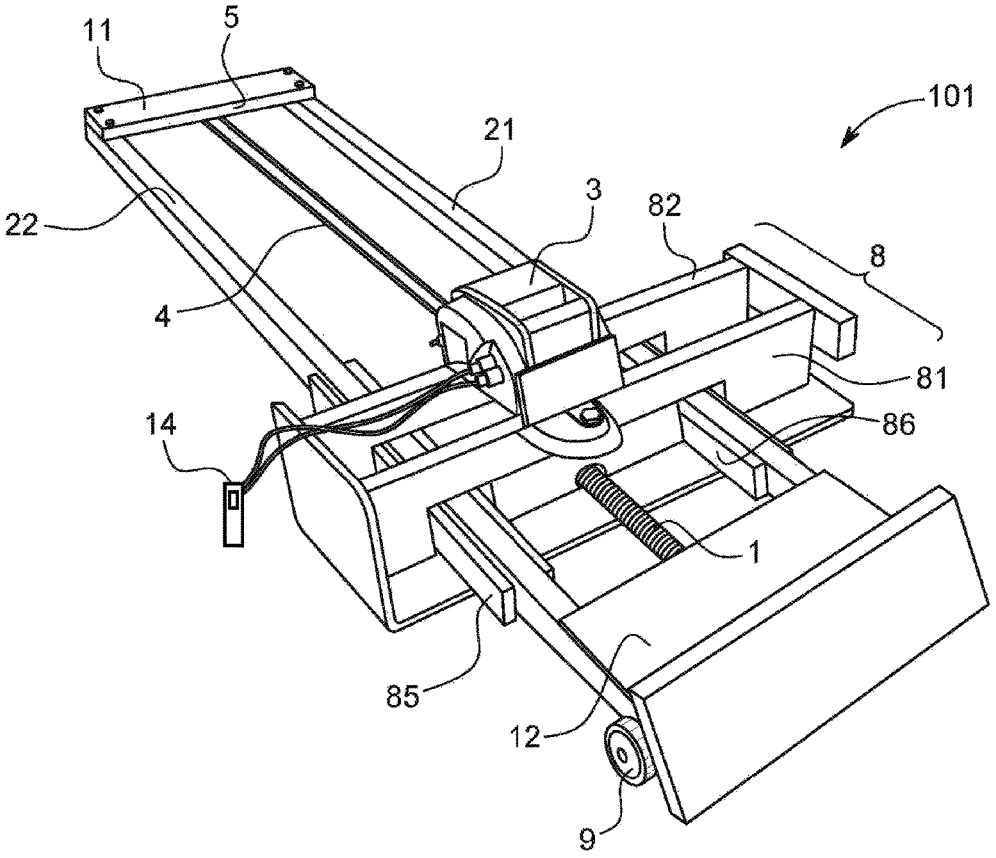
FIG. 2A illustrates an isometric view of the herein disclosed shingle installation jack, in accordance with the present invention.
Figure 2B:
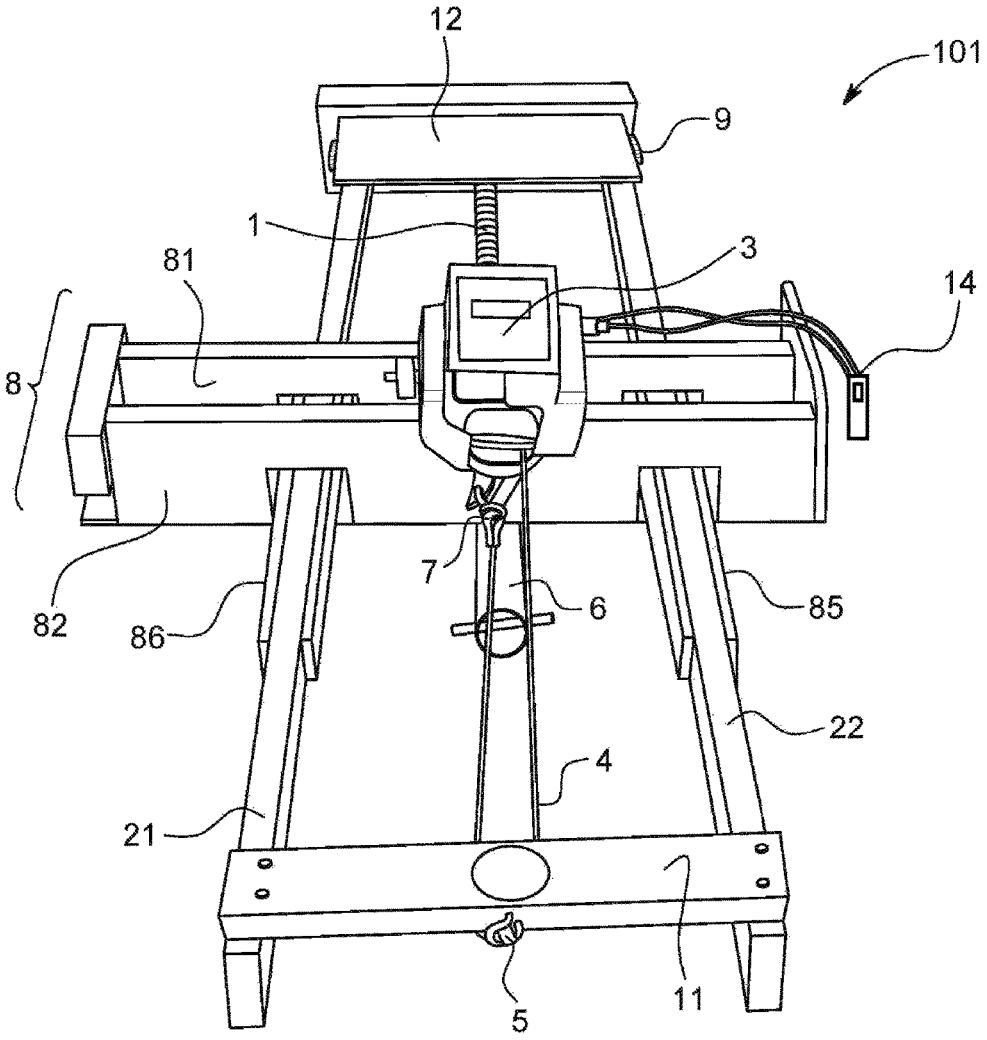
FIG. 2B illustrates an alternative isometric view (from a different angle) of the herein disclosed shingle installation jack, in accordance with the present invention.

Referring to FIG. 2A and FIG. 2B, an exemplary embodiment of a herein disclosed shingle installation jack device 101 is shown from two angles to illustrate the various components. Shingle installation jack device 101 includes mounting assembly 8 supporting and controlling the positioning (or height or level) of a slidable (or mechanically moveable) frame. The frame includes bottom member 11, first slider member 21, second slider member 22, and top member 12. Bottom member 11 is in parallel with top member 12 and first slider member 21 is in parallel with second slider member 22. Bottom member 11 may be formed of any rigid material (wood, for example) and securely anchors pulley 5. Pulley 5 may be any type or size of pulley, but is a 2.5 inch diameter pulley in a preferred embodiment. Top member 12 may be formed of any rigid material (wood, for example) and supports a walk board by providing a rigid surface that may be placed (or secured) underneath a walk board. Top member 12 also anchors a first end of spring 1. First slider member 21 and second slider member 22 may be formed of any rigid material, but in a preferred embodiment the two slider members may be formed of a metal such as steel. Both first slider member 21 and second slider member 22 may be of any dimensions those skilled in the art will recognize as providing enough support and security for supporting walk board 120; in a preferred embodiment, each of the slider members may have a height of 4 inches, a width of 2 inches, and a length of 8 feet. The purpose of the frame is to provide a rigid structure that may be controllably moved (or slide) up and down along the plane of a slanted roof by winch motor 3 (which may be controlled by a remote control 14), in order to facilitate the mechanically aided adjustment of walk board 120 for improved shingle installation and/or repair.

Shingle installation jack device 101 further includes mounting assembly 8. Mounting assembly 8 may be removably but securely attached (or anchored) onto roof 101 at a fixed position. Mounting assembly 8 anchors winch motor 3 and may be formed of any rigid material (wood, for example). Winch motor 3 may be any type of winch or mechanical device that may be used to wind up, wind down, or adjust the tension or effective length of a rope, wire, or cable. Winch motor 3 may be, in certain embodiments, controllable by a remote-control 14 (depicted as communicative wiring in the Figures that runs to a remote-control unit, not depicted, as is known in the art). Mounting assembly 8 includes upper surface 81 and a lower surface 82. In an exemplary embodiment (and as depicted in the Figures), winch motor 3 may be anchored between upper surface 81 and lower surface 82. Upper surface 81 anchors a second end of spring 1 (the first end of spring 1 is anchored by top member 12, as described above). Lower surface 82 anchors eye bolt 7 (visible in FIG. 2B, but not seen in FIG. 2A due to the viewing angle). Lower surface 82 may additionally anchor spring positioning pipe 6. In an exemplary embodiment, spring positioning pipe 6 may be formed of a 2-inch diameter stainless steel pipe and is intended to keep spring 1 in a proper alignment. Spring 1 may be any type of heavy duty spring capable of expending enough to allow a full range of motion for the frame of shingle installation jack device 101. In a preferred embodiment, spring 1 may be a standard garage door spring. Spring 1 spans from top member 12 of the frame to upper surface 81 of mounting assembly. In an alternative embodiment, spring 1 may span through mounting assembly 8 and be anchored directly to spring positioning pipe 6.

Cable 4 runs from winch motor 3, through pulley 5, and back to eye bolt 7, where cable 4 is securely attached. Cable 4 has an adjustable effective length, meaning that winch motor 3 can wind up (or wind out) cable 4 and thus adjust the effective length of the cable. The effective length of cable 4 is the length from lower surface 82 of mounting assembly 8 to pulley 5. Cable 4 may be any type of heavy cable, wire, rope, or the equivalent capable of being wound up or wound out by winch motor 3. In a preferred embodiment, cable 4 may be an ⅛-inch diameter steel cable.

Herein disclosed shingle installation jack device 101 may include one or more sets of wheels 9 for transporting the shingle installation device 101. In a preferred embodiment, one set of wheels 9 may be attached to top member 12 of the frame. In such an embodiment, a user can lift one end of shingle installation jack device 101 by bottom member 11, and roll shingle installation jack device 101 on set of wheels 9 to transport the device along the ground or along a rooftop. Those skilled in the art will recognize that alternative positions are possible for one or more sets of wheels, and all such positions are intended to be included herein.

In a preferred embodiment (and as depicted in FIG. 2A and FIG. 2B), mounting assembly 8 of the herein disclosed shingle installation jack device 101 may include a first slider support 85 and a second slider support 86. The slider supports may protrude from mounting assembly 8 in one direction or in both directions (as is shown in the Figures), and function to stabilize the frame as the frame is slide up or down during operation. First slider support 85 may include a first beam and a second beam positioned in parallel and spaced apart enough to form a first channel within which first slider member 21 may slide up and down as controlled by winch motor 3. Second slider support 86 may include a third beam and a fourth beam positioned in parallel and spaced apart enough to form a second channel within which second slider member 22 ma slide up and down as controlled by winch motor 3.

While the present invention has been illustrated and described herein in terms of a preferred embodiment and several alternatives, it is to be understood that the devices described herein can have a multitude of additional uses and applications. Accordingly, the invention should not be limited to just the particular description and various drawing figures contained in this specification that merely illustrate a preferred embodiment and application of the principles of the invention.

What is claimed is:

1. A shingle installation device, comprising:

a frame having a bottom member for anchoring a pulley, a first slider member, a second slider member, and a top member for supporting a walk board and for anchoring a first end of a spring, wherein the top member is in parallel with the bottom member and the first slider member is in parallel with the second slider member;

a mounting assembly for anchoring a winch motor, wherein the mounting assembly has an upper surface for anchoring a second end of the spring and a lower surface for anchoring an eye bolt;

a cable having an adjustable effective length running from the winch motor, through the pulley, and back to the eye bolt, wherein the adjustable effective length of the cable is controllable by the winch motor; and the spring spanning from the top member of the frame to the upper surface of the mounting assembly.

2. The shingle installation device as recited in claim 1, wherein the spring is a garage door type spring.

3. The shingle installation device as recited in claim 1, wherein the first slider member has a height of 4 inches, a width of 2 inches, and a length of 8 feet, and wherein the second slider member has a height of 4 inches, a width of 2 inches, and a length of 8 feet.

4. The shingle installation device as recited in claim 1, wherein the cable has a diameter of $\frac{1}{8}^{th}$ inches and is formed of steel.

5. The shingle installation device as recited in claim 1, wherein the pulley has a diameter of 2.5 inches.

6. The shingle installation device as recited in claim 1, further comprising a spring positioning pipe for aligning the spring, wherein the spring positioning pipe is anchored to the mounting assembly.

7. The shingle installation device as recited in claim 6, wherein the spring positioning pipe has a diameter of 2 inches and is formed of stainless steel.

8. The shingle installation device as recited in claim 1, further comprising one or more sets of wheels for transporting the shingle installation device.

9. The shingle installation device as recited in claim 8, wherein at least one set of wheels of the one or more sets of wheels is anchored to the top member of the frame.

10. The shingle installation device as recited in claim 1, wherein the mounting assembly further comprises a first slider support and a second slider support.

11. The shingle installation device as recited in claim 10, wherein the first slider support includes a first beam and a second beam, and wherein the first slider member moves within a first channel formed by the first beam and the second beam; and wherein the second slider support includes a third beam and a fourth beam, and wherein the second slider member moves within a second channel formed by the third beam and the fourth beam.

* * * * *